US005941211A

United States Patent [19]

Brehob et al.

[11] Patent Number: 5,941,211

[45] Date of Patent: Aug. 24, 1999

[54] DIRECT INJECTION SPARK IGNITION ENGINE HAVING DECELERATION FUEL SHUTOFF

[75] Inventors: Diana Dawn Brehob; Todd Arthur Kappauf, both of Dearborn; Richard Walter Anderson, Ann Arbor, all of Mich.

[73] Assignee: Ford Global Technologies, Inc., Dearborn, Mich.

[21] Appl. No.: 09/024,153

[22] Filed: Feb. 17, 1998

[51] Int. Cl.[6] ..... F02D 9/06

[52] U.S. Cl. ..... 123/325; 123/493; 60/274; 60/285

[58] Field of Search ..... 123/325, 493; 60/274, 285

[56] References Cited

U.S. PATENT DOCUMENTS

| | | | |
|---|---|---|---|
| 4,327,682 | 5/1982 | Harada . | |
| 4,414,941 | 11/1993 | Nakanishi . | |
| 4,466,413 | 8/1984 | Oonishi et al. . | |
| 4,475,501 | 10/1984 | Kato et al. | 123/325 |
| 4,539,643 | 9/1985 | Suzuki et al. . | |
| 4,558,672 | 12/1985 | Boccadoro et al. . | |
| 4,648,370 | 3/1987 | Kobayashi et al. . | |
| 4,697,559 | 10/1987 | Suzuki et al. | 123/325 |
| 4,729,220 | 3/1988 | Terasaka et al. . | |
| 4,790,275 | 12/1988 | Iida . | |
| 4,944,358 | 7/1990 | Wazaki et al. | 123/325 |
| 4,964,271 | 10/1990 | Sawada | 123/325 |
| 5,119,781 | 6/1992 | Trombley et al. . | |
| 5,402,641 | 4/1995 | Katoh et al. . | |
| 5,423,181 | 6/1995 | Katoh et al. . | |
| 5,515,824 | 5/1996 | Yamagishi et al. | 60/285 |
| 5,784,880 | 7/1998 | Toshiro et al. | 60/285 |
| 5,842,339 | 12/1998 | Bush et al. | 60/274 |
| 5,848,528 | 12/1998 | Liu | 60/274 |

*Primary Examiner*—John Kwon
*Attorney, Agent, or Firm*—Neil P. Ferraro

[57] ABSTRACT

A method of controlling fuel supply during a deceleration fuel shutoff mode includes determining the amount of oxygen stored in the catalyst or the temperature thereof and intermittently supplying fuel to the engine such that the fuel reacts in the catalyst to reduce excess oxygen therein.

21 Claims, 3 Drawing Sheets

DIRECT INJECTION SPARK IGNITION ENGINE HAVING DECELERATION FUEL SHUTOFF

FIELD OF THE INVENTION

The present invention relates to fuel injection strategies for direct injection spark ignition engines operating in deceleration fuel shutoff modes.

BACKGROUND OF THE INVENTION

During periods of vehicle deceleration, it would be desirable, from a fuel economy standpoint, to discontinue fuel delivery to the engine. However, present deceleration fuel shutoff strategies may cause engine harshness when refueling commences. In addition, the exhaust system's catalyst may be exposed to nearly pure air when fueling ceases. Because a catalyst absorbs oxygen, when refueling commences, the catalyst containing excess oxygen cannot effectively reduce nitrogen oxides ($NO_x$) until the excess oxygen is purged. During the excess oxygen removal period, substantial quantities of $NO_x$ may break through the catalyst causing a vehicle to fall out of exhaust emission compliance.

SUMMARY OF THE INVENTION

An object of the present invention is to provide an engine having greater fuel economy while limiting $NO_x$ emissions. This object is achieved and disadvantages of prior art approaches are overcome by providing a novel method of controlling fuel supply to a direct injected spark ignition engine. The engine has an engine block, at least one piston moveable within at least one cylinder in the engine block, at least one combustion chamber defined by a piston and the engine block, a fuel injector disposed to inject fuel directly into the combustion chamber and an exhaust catalyst coupled to the combustion chamber. In one particular aspect of the invention, the method includes the steps of determining an engine operating condition; ceasing continuous fuel supply during a predetermined engine operating condition based on said determined engine operating condition; determining an operating condition of the catalyst during said predetermined engine operating condition; and, intermittently supplying fuel to the engine based on said determined catalyst operating condition such that the intermittently supplied fuel reacts in the catalyst to reduce excess stored oxygen in the catalyst.

In a preferred embodiment, the method further includes the steps of detecting a demand for engine acceleration; supplying a continuous amount of fuel to the engine in response to said demand; and advancing ignition timing from a retarded ignition timing to provide a smooth transition upon supplying the continuous amount of fuel to the engine.

An advantage of the present invention is that fuel economy is enhanced.

Another advantage of the present invention is that $NO_x$ emissions are reduced.

Yet another advantage of the present invention is that smooth transitions between operating modes are obtained.

Other objects, features and advantages of the present invention will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

Figure 1:
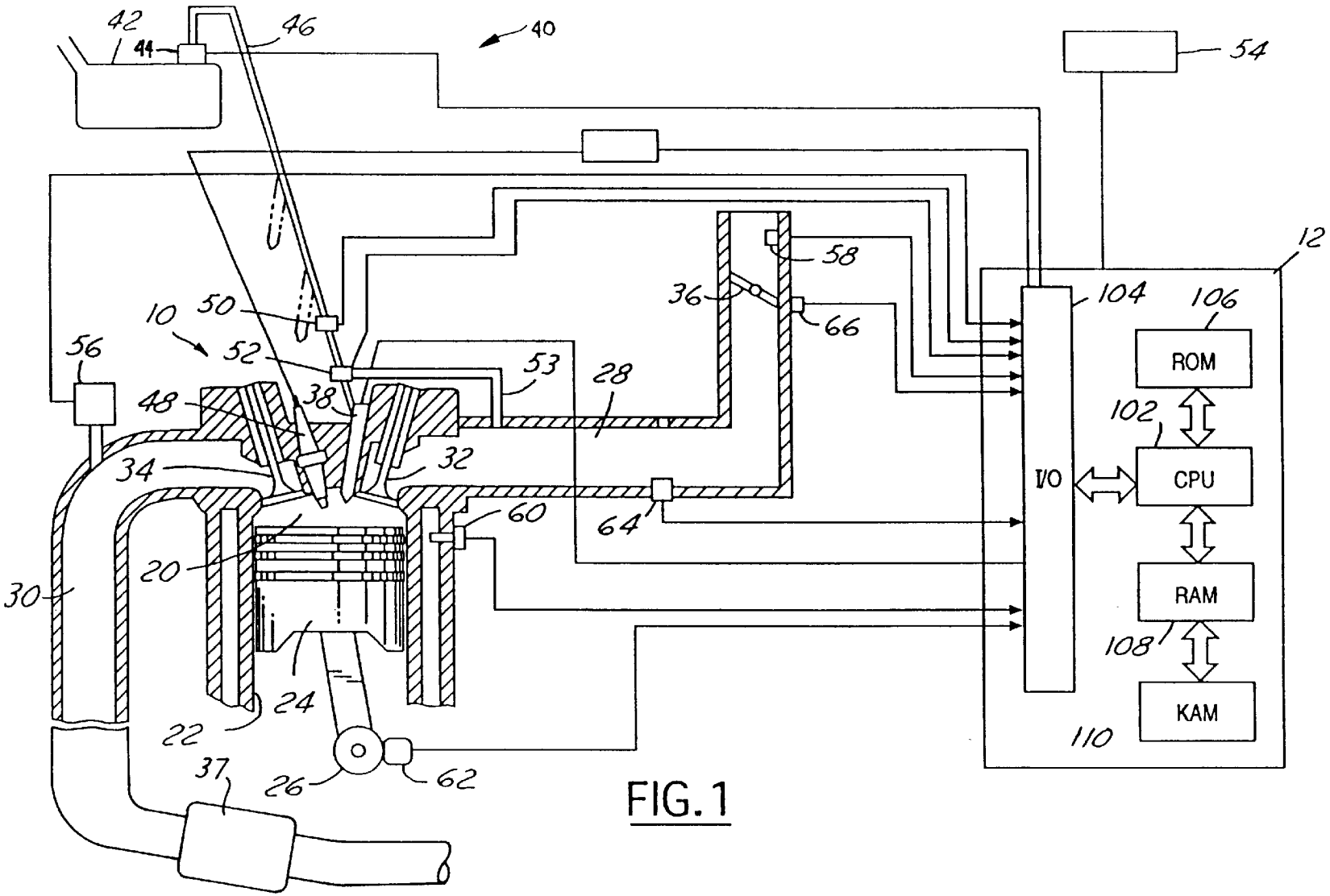
FIG. 1 is a block diagram of a direct injection spark ignition engine incorporating the present invention.

Direct injection spark ignition internal combustion engine 10, comprising a plurality of cylinders, one of which is shown in FIG. 1, is controlled by electronic engine controller 12. Engine 10 includes combustion chamber 20 and cylinder wall 22. Piston 24 is positioned within cylinder wall 22 with conventional piston rings and is connected to crankshaft 26. Combustion chamber 20 communicates with intake manifold 28 and exhaust manifold 30 by intake valve 32 and exhaust valve 34, respectively. Intake manifold 28 communicates with throttle 36 for controlling combustion air entering combustion chamber 20. Exhaust manifold 30 communicates with exhaust catalyst 37. As used herein, catalyst 37 may be a conventional three-way catalyst (TWC), a lean $NO_x$ trap, $NO_x$ reducing catalyst, or any other oxygen storage exhaust gas treatment device known to those skilled in the art and suggested by this disclosure. Fuel injector 38 is mounted to engine 10 such that fuel is directly injected into combustion chamber 20 in proportion to a signal received from controller 12.

Fuel is delivered to fuel injector 38 by, for example, electronic returnless fuel delivery system 40, which comprises fuel tank 42, electric fuel pump 44 and fuel rail 46. Fuel pump 44 pumps fuel at a pressure directly related to the voltage applied to fuel pump 44 by controller 12. Those skilled in the art will recognize in view of this disclosure, that a high pressure fuel pump (not shown) may be used in fuel delivery system 40. Once fuel has entered combustion chamber 20, it is ignited by means of spark plug 48. Also coupled to fuel rail 46 are fuel temperature sensor 50 and fuel pressure sensor 52. Pressure sensor 52 senses fuel rail pressure relative to manifold absolute pressure (MAP) via sense line 53. Ambient temperature sensor 54 may also be coupled to controller 12.

Controller 12, shown in FIG. 1, is a conventional microcomputer including microprocessor unit 102, input/output ports 104, electronic storage medium for storing executable programs, shown as "Read Only Memory" (ROM) chip 106, in this particular example, "Random Access Memory" (RAM) 108, "Keep Alive Memory" (KAM) 110 and a conventional data bus. Controller 12 receives various signals from sensors coupled to engine 10, in addition to those signals previously discussed, including: ambient air temperature from temperature sensor 54, measurement of mass air flow from mass air flow sensor 58, engine temperature from temperature sensor 60, a profile ignition pick-up signal from Hall effect sensor 62, coupled to crankshaft 26, intake manifold absolute pressure (MAP) from pressure sensor 64 coupled to intake manifold 28, and position of throttle 36 from throttle position sensor 66.

Figure 2:
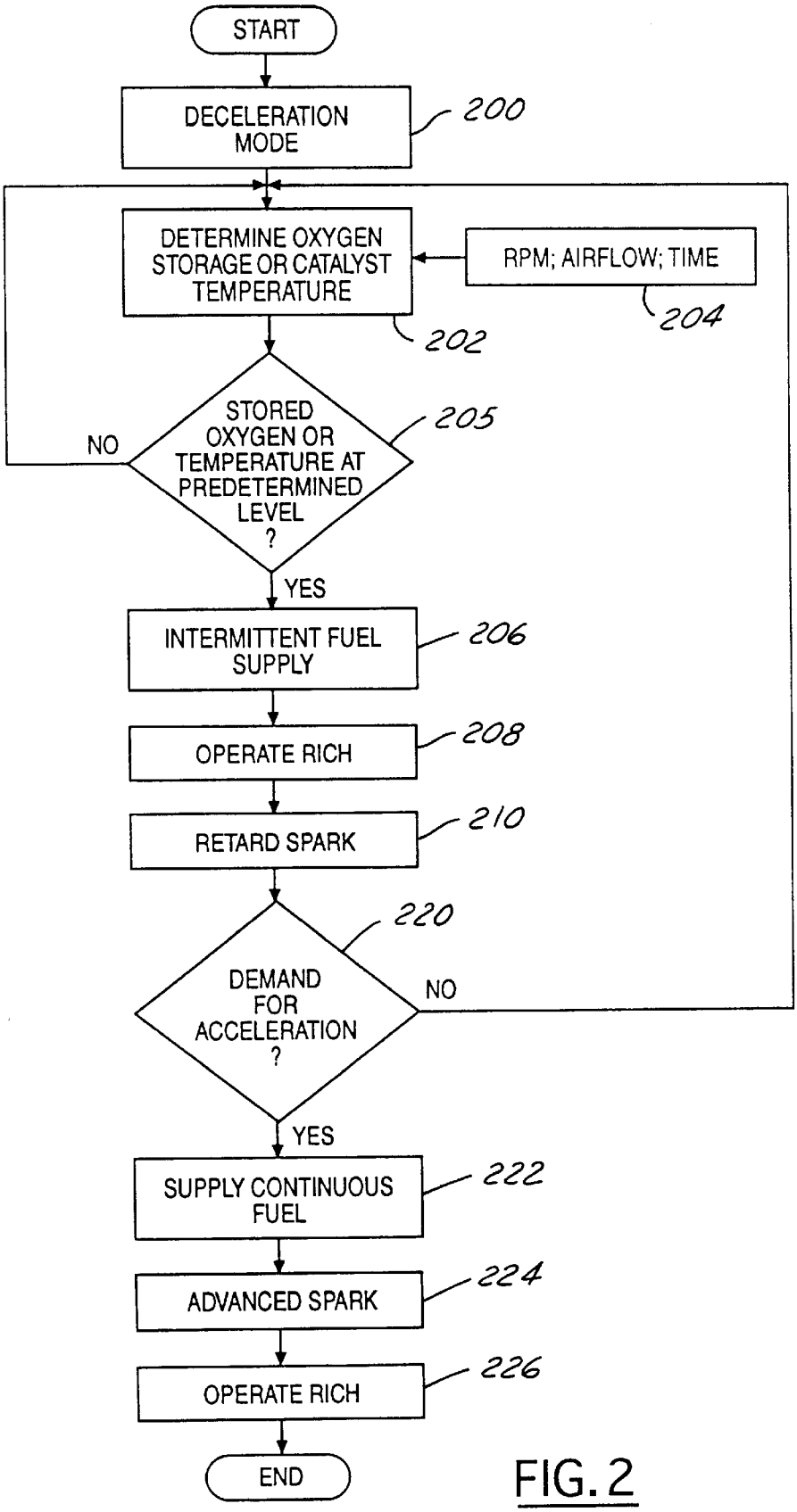
FIG. 2 is a flow chart describing various operations performed by the present invention; and, FIG. 3 is a graphical representation showing the results of a preferred embodiment.

Referring to FIG. 2, according to the present invention, controller 12 controls fuel supply to engine 10. At step 200, controller 12, in response to a plurality of engine operating conditions as sensed by the various, previously stated, sensors, determines whether the engine is in a deceleration mode, whereby continuous fuel supply may be temporarily ceased. Next, at step 202, controller 12 determines the amount of oxygen stored in catalyst 37. This may be accomplished, as shown at step 204, by integrating the engine speed or airflow over a period of time and knowing the oxygen storage capability of the catalyst. The amount of oxygen stored is then compared with a predetermined level at step 205. At step 206, should the oxygen storage capacity of catalyst 37 exceed the predetermined level, controller 12 intermittently supplies fuel to engine 10 such that the intermittently supplied fuel reacts in the catalyst to reduce excess stored oxygen therein. The amount of intermittently supplied fuel to the engine may proceed for a number of engine cycles based on the amount of oxygen stored in the catalyst as determined by controller 12 at step 202. It should be noted that the intermittently injected fuel may or may not be ignited in the combustion chamber.

Alternatively, controller 12 may intermittently supply fuel when the temperature of catalyst 37 reaches a predetermined temperature. That is, it may be desirable that the intermittent fuel supply occur when the catalyst temperature has lowered to a predetermined temperature. The temperature of catalyst 37 may be detected directly via a temperature sensor or via a temperature estimating model known to those skilled in the art. The added fuel would oxidize with the $NO_x$ as well as maintain the catalyst operating temperature at desired levels.

In a preferred embodiment, as shown at step 208, the intermittent fuel supply combines with the air to produce a relatively rich air/fuel mixture entering the engine. By operating in a fuel rich condition, the amount of $NO_x$ produced in the combustion process is greatly reduced. The products of combustion exhausted from the engine will contain little $NO_x$, but high levels of unburned fuel components, such as unburned fuel fragments, CO and hydrogen. These unoxidized components would react in the catalyst with the stored oxygen. Thus, although the exhaust from the engine would be relatively high in undesirable unburned species, the catalyst would contain excess oxygen required to oxidize the unburned species prior to release. $NO_x$ may further be reduced by retarding the spark timing during these rich cycles, as shown in step 210, if ignition of the fuel occurs in the combustion chamber.

Also, according to the present invention, as shown at step 220, controller 12 detects whether a demand for engine acceleration is required. If no demand for engine acceleration is required, the process moves back to step 202. On the other hand, if a demand for acceleration is found at step 220, controller 12 then supplies a continuous amount of fuel to the engine, shown at step 222, and advances the ignition timing, shown at step 224, from the retarded ignition timing (step 210). Spark timing is advanced to provide a smooth transition upon supplying the continuous amount of fuel to the engine.

Figure 3:
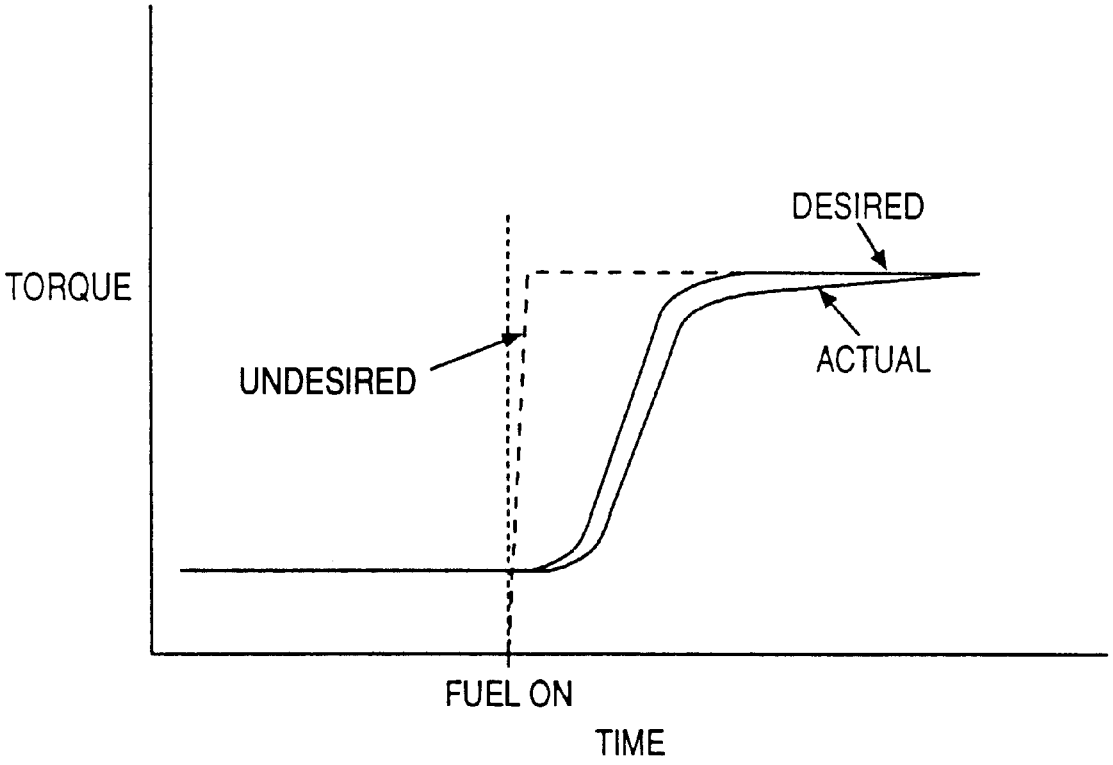

Referring in particular to FIG. 3, when controller 12 commands the fuel on upon demand for acceleration, without advancing the ignition timing, the torque output would follow a step function, as shown by the dashed line labeled "Undesired". However, the vehicle driver would prefer to have a smooth torque transition, such as that shown by the solid line labeled "Desired". With ignition timing advance, the actual torque output ("Actual") closely follows the desired torque output ("Desired"), as shown.

Continuing with reference to FIG. 2, as shown at step 226, excess fuel may be supplied in this continuous fuel supply mode (acceleration) to produce a rich air/fuel mixture. For the reasons previously stated, operating the engine in a rich mode, unburned hydrocarbons would react with the excess oxygen in the catalyst to oxidize prior to release into the atmosphere. It should be noted that the rich air-fuel mixture operation may occur in a single engine cycle or extend over a predetermined number of engine cycles. Then, the air-fuel mixture would revert to a stoichiometric or lean condition, as desired. In addition, the amount of "richness" may be based on the amount of oxygen stored in catalyst 37.

While the best mode for carrying out the invention has been described in detail, those skilled in the art in which this invention relates will recognize various alternative designs and embodiments, including those mentioned above, in practicing the invention that has been defined by the following claims.

We claim:

1. A method of controlling fuel supply in a direct injection spark ignition engine, the engine having an engine block, at least one piston moveable within at least one cylinder in the engine block, at least one combustion chamber defined by a piston and engine block, a fuel injector disposed to inject fuel directly into the combustion chamber and an exhaust catalyst coupled to the combustion chamber, with said method comprising the steps of:

determining an engine operating condition;

ceasing continuous fuel supply during a predetermined engine operating condition based on said determined engine operating condition;

determining an operating condition of the catalyst during said predetermined engine operating condition; and, intermittently supplying fuel to the engine based on said determined catalyst operating condition such that said intermittently supplied fuel reacts in the catalyst to reduce excess stored oxygen in the catalyst.

2. A method according to claim 1 wherein the step of determining an operating condition of the catalyst comprises the step of determining an amount of oxygen stored in the catalyst.

3. A method according to claim 2 wherein an amount of fuel supplied during said step of intermittently supplying fuel to the engine is based on an amount of oxygen stored in the catalyst as determined during the step of determining an amount of oxygen stored in the catalyst.

4. A method according to claim 2 wherein said step of intermittently supplying fuel to the engine proceeds for a number of engine cycles based on an amount of oxygen stored in the catalyst as determined during the step of determining an amount of oxygen stored in the catalyst.

5. A method according to claim 1 wherein the step of intermittently supplying fuel to the engine comprises the step of supplying excess fuel relative to an amount of air entering the combustion chamber to produce a rich air-fuel mixture.

6. A method according to claim 1 wherein said step of determining an amount of oxygen stored in the catalyst comprises the step of determining an amount of air flow through the engine.

7. A method according to claim 1 wherein said step of determining an amount of oxygen stored in the catalyst comprises the step of sensing engine speed.

8. A method according to claim 1 wherein the step of determining an operating condition of the catalyst comprises the step of determining an operating temperature of the catalyst.

9. A method according to claim 8 further comprising the step of raising an operating temperature of the catalyst.

10. A method according to claim 9 wherein the step of raising an operating temperature of the catalyst comprises the step of retarding ignition timing from an optimum ignition timing.

11. A method according to claim 1 further comprising the steps of:

detecting a demand for engine acceleration;

supplying a continuous amount of fuel to the engine in response to said demand; and advancing ignition timing from a retarded ignition timing to provide a smooth transition upon supplying the continuous amount of fuel to the engine.

12. A method according to claim 11 wherein said step of supplying a continuous amount of fuel to the engine comprises the step of supplying excess fuel relative to an amount of air entering the combustion chamber to produce a rich air-fuel mixture.

13. A system for controlling oxides of nitrogen emission from a direct injection spark ignition engine during deceleration comprising:

an exhaust catalyst coupled to the engine;

a sensor for sensing an engine operating condition; and, a controller responsive to said sensor for controlling fuel supply to the engine, with said controller determining an operating condition of said catalyst during deceleration and intermittently supplying fuel to the engine based on said catalyst operating condition such that said intermittently supplied fuel reacts in said catalyst to reduce excess stored oxygen in said catalyst.

14. A system according to claim 13 wherein said catalyst operating condition is one of oxygen storage or temperature.

15. A system according to claim 13 wherein said controller intermittently supplies fuel to the engine for a predetermined number of engine cycles based on said determined catalyst operating condition.

16. A system according to claim 14 wherein said controller intermittently supplies excess fuel to the engine relative to an amount of air entering the engine to produce a rich air-fuel mixture.

17. A system according to claim 14 wherein, upon demand for engine acceleration, said controller supplies a steady amount of excess fuel to the engine, with said excess fuel being relative to an amount of air entering the engine to produce a rich air-fuel mixture, and advances ignition timing from a retarded ignition timing.

18. An article of manufacture comprising:

a computer storage medium having a computer program encoded therein for causing a computer to control fuel supply in a direct injection spark ignition engine, the engine having an engine block, at least one piston moveable within at least one cylinder in the engine block, at least one combustion chamber defined by a piston and engine block, a fuel injector disposed to inject fuel directly into the combustion chamber and an exhaust catalyst coupled to the combustion chamber, with said computer storage medium comprising:

a computer readable program code means for causing a computer to determine an engine operating condition;

a computer readable program code means for causing a computer to cease continuous fuel supply during a predetermined engine operating condition based on said determined engine operating condition;

a computer readable program code means for causing a computer to determine a catalyst operating condition during said predetermined engine operating condition; and, a computer readable program code means for causing a computer to intermittently supply fuel to the engine based on said determined catalyst operating condition such that said intermittently supplied fuel reacts in the catalyst to reduce excess stored oxygen in the catalyst.

19. An article of manufacture according to claim 18 further comprising a computer readable program code means for causing said computer to intermittently supply excess fuel to the engine for a number of engine cycles based on said determined catalyst operating condition, with said excess fuel being relative to an amount of air entering the engine to produce a rich air-fuel mixture.

20. An article of manufacture according to claim 18 further comprising a computer readable program code means for causing said computer to, upon demand for engine acceleration, supply a continuous amount of excess fuel to the engine, with said excess fuel being relative to an amount of air entering the engine to produce a rich air-fuel mixture, and advance ignition timing from a retarded ignition timing to provide a smooth transition upon supplying the continuous amount of fuel to the engine.

21. An article of manufacture according to claim 18 wherein said computer storage medium comprises an electronically programmable chip.

* * * * *